United States Patent [19]

Mueller

[11] Patent Number: 4,639,063

[45] Date of Patent: Jan. 27, 1987

[54] ELECTRICAL CONNECTOR FOR FLEXIBLE FILM CIRCUITS

[75] Inventor: Arthur L. Mueller, Camp Hill, Pa.

[73] Assignee: AMP Incorporated, Harrisburg, Pa.

[21] Appl. No.: 811,580

[22] Filed: Dec. 20, 1985

[51] Int. Cl.[4] ..... H01R 9/09

[52] U.S. Cl. ..... 339/75 M; 339/17 F; 339/176 MF

[58] Field of Search ..... 339/17 F, 17 CF, 75 M, 339/75 MP, 176 MF

[56] References Cited

U.S. PATENT DOCUMENTS

| | | | |
|---|---|---|---|
| 3,904,262 | 9/1975 | Cutchan | 339/17 CF |
| 4,235,500 | 11/1980 | Belopavlovich et al. | 339/176 MF |
| 4,395,084 | 7/1983 | Conrad | 339/17 CF |
| 4,437,718 | 3/1984 | Selinko | 339/17 CF |
| 4,456,318 | 6/1984 | Shibata et al. | 339/75 MP |
| 4,477,137 | 10/1984 | Ayer | 339/176 MF |

*Primary Examiner*—John McQuade

*Attorney, Agent, or Firm*—Allan B. Osborne

[57] ABSTRACT

An electrical connector for receiving and retaining a flexible film strip and electrically connecting conductors thereon to circuit traces on a circuit board on which the connector is mounted. More particularly, the connector includes contact units of contact elements mounted in insulative members which are received in the connector housing and a cover which is cammed down to wipingly press the conductors on the flexible film strip against cantilever spring arms on the contact elements.

19 Claims, 12 Drawing Figures

ELECTRICAL CONNECTOR FOR FLEXIBLE FILM CIRCUITS

FIELD OF THE INVENTION

The present invention relates to electrical connectors for interconnecting parallel, spaced apart circuits on a flexible film strip to like parallel, spaced apart circuits on a circult board.

BACKGROUND OF THE INVENTION

Connectors disclosed in U.S. Pat. Nos. 3,629,787; 4,252,389 and 4,334,728 include spring means which press conductors on flexible film directly against circuit traces on a circuit board on which the connectors are mounted. Whereas such connectors contain few parts, are reliable and relatively inexpensive, the use thereof is limited to circuit boards having accessible circuit traces for the aforementioned conductor to circuit trace engagement. Accordingly, circuit boards, particularly multi-layer boards, using surface mount or through-hole means intermediate the circuit traces thereon are not able to use these type connectors.

It is, therefore, necessary to provide an electrical connector for flexible film circuitry that can be mounted on a circuit board and which includes discrete contact elements capable of being electrically connected to circuit through holes, plated-through holes or surface mount conductive pads.

SUMMARY OF THE INVENTION

According to the present invention, an electrical connector for interconnecting conductors on a flexible film strip to circuit traces on a circuit board includes a dielectric housing having a passage therethrough and first cam means on opposing side walls. A contact unit including spaced contact elements imbedded in an insulative member is disposed in the passage with cantilever spring arms of the contact elements extending upwardly to engage respective conductors of a film strip and lower portions of the contact elements extending from the housing to engage respective circuit traces on the circuit board on which the electrical connector is mounted. Further included is a cover having a base member located across the top of the housing with the film strip therebetween and plates extending downwardly from each side of the base member and over the side walls of the housing. Each plate includes cam means engaging the cam means on the side walls of the housing so that as the cover is moved parallel to the plane of the top surface of the housing, the cam means cooperate to cause the base member to press the film strip against the cantilever spring arms. Locking means for releasably locking the cover to the housing in a closed position is also included.

DESCRIPTION OF THE INVENTION

Figure 1:
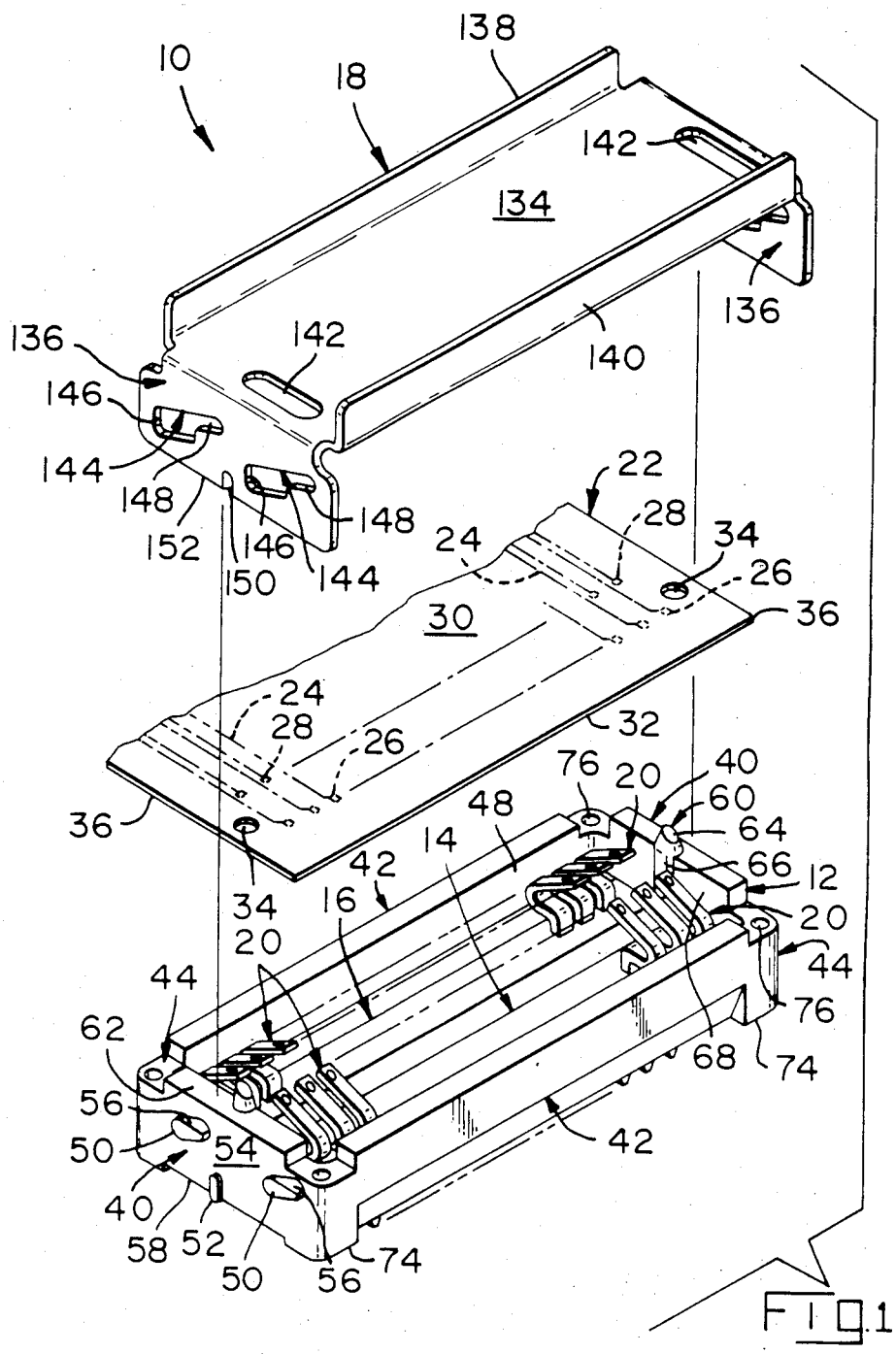
FIG. 1 is a perspective view of the preferred embodiment of an electrical connector of the present invention with the cover exploded therefrom and also part of a flexible film strip suitable for terminating therein.
Figure 2:
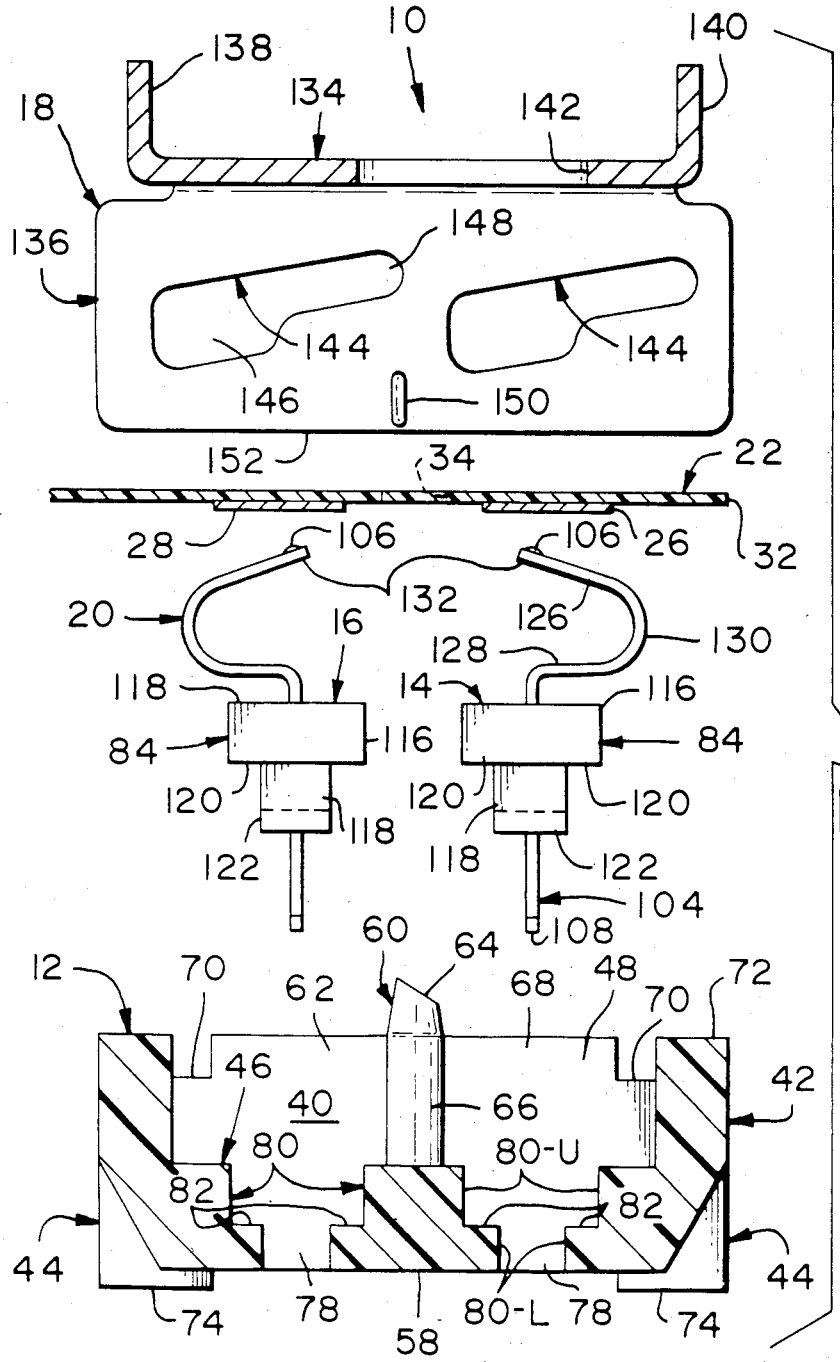
FIG. 2 is a partly sectioned, exploded side view of the electrical connector.

As shown in FIGS. 1 and 2, electrical connector 10 of the present invention includes housing 12, identical contact units 14, 16 and cover 18.

Figure 3:
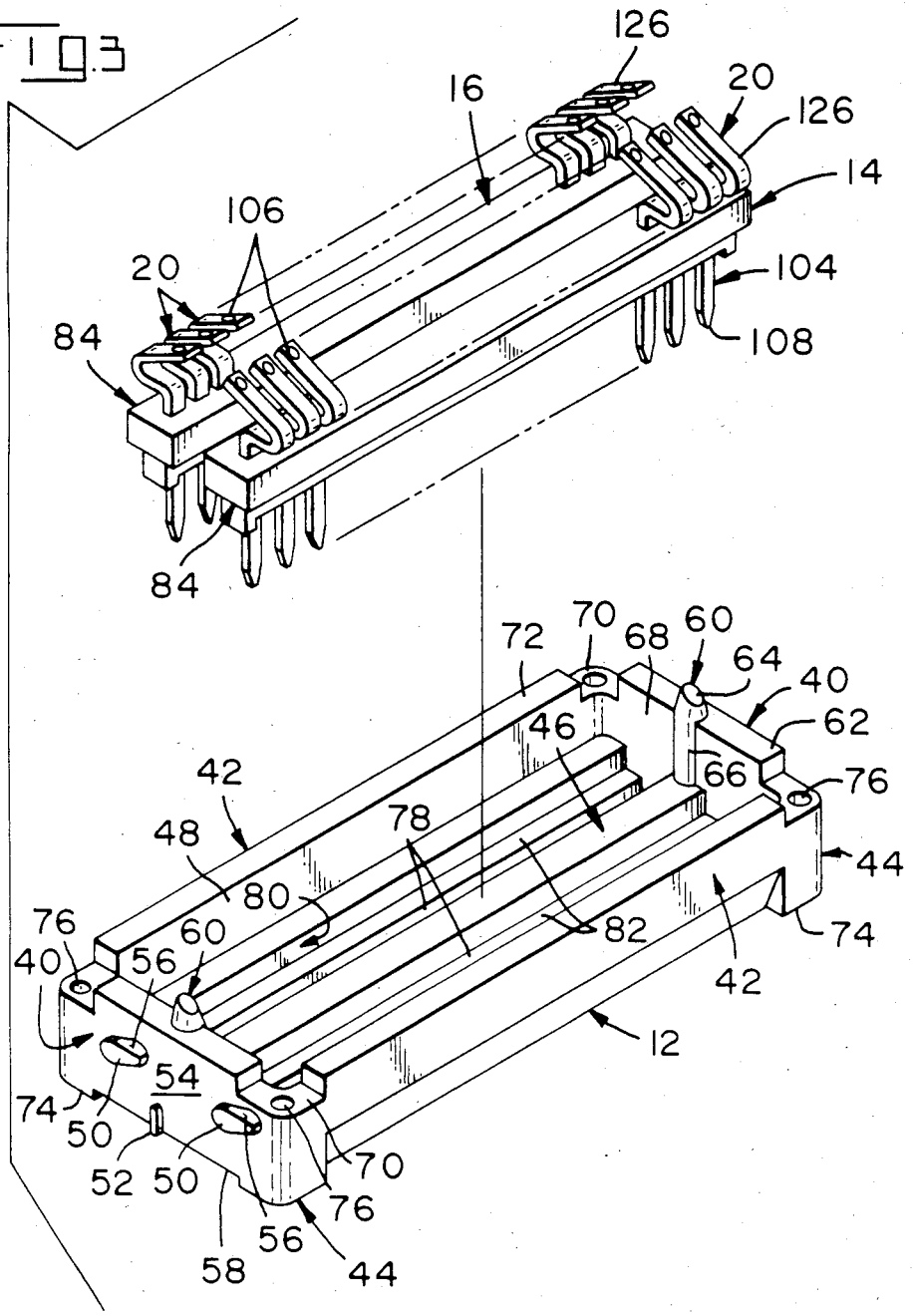
FIG. 3 is an exploded perspective view of the connector housing and the two insert molded contact element units positionable therein.

As shown more clearly in FIG. 3, each contact unit 14, 16 includes a plurality of conductive contact elements 20.

Also shown in FIGS. 1 and 2 is flexible film strip 22 having conductors 24 therein which terminate in conductive pads 26, 28 on surface 30. Pads 26, 28 are arranged in two rows extending across the width of strip 22 with pads 26 in the row closest to end edge 32 and pads 28 being in a row located inwardly therefrom. In addition, hole 34 is provided along each side edge 36 of strip 22. As will be shown in FIG. 10, conductors 24 are electrically connected to circuit traces 37 on circuit board 38 (FIGS. 7 through 12) through electrical engagement between pads 26, 28 and contact elements 20.

Connector housing 12 is preferably molded from a suitable insulating material such as polyphenylene sulfide, a plastic made and sold by the Phillips Petroleum Company under the trademark RYTON. As shown in FIGS. 1, 2 and 3, housing 12 includes opposing side walls 40, opposing end walls 42 with corner blocks 44 joining side and end walls 40, 42 and floor 46. Walls 40, 42, blocks 44 and floor 46 cooperate to define upwardly opening cavity 48.

Figure 9:
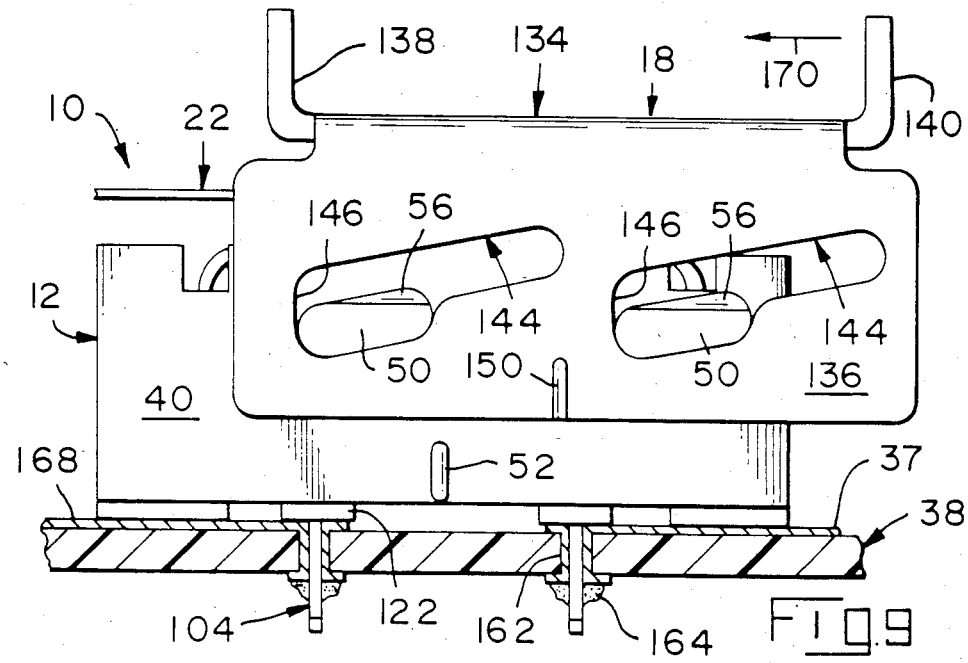
FIG. 9 is a side view of the electrical connector shown in FIG. 7.

A pair of spaced apart, outwardly projecting cam bosses 50 and a short, vertical rib 52 are provided on outer surface 54 of each side wall 40. Each cam boss 50 is oval shaped at its attachment to side wall 40 and is at an oblique angle relative to the horizontal plane of housing 12. Upper surface 56 of each cam boss 50, as best shown in FIG. 9, is beveled and slopes downwardly to facilitate assembling cover 18 onto housing 12. Ribs 52 are located adjacent bottom surface 58 of housing 12 and intermediate corner blocks 44.

Film locating and retaining posts 60 extend upwardly from top edge 62 of each side wall 40 and include beveled surface 64 to facilitate receiving film strip 22 thereonto. Arcuate-shaped portions 66, a continuation of posts 60, extend downwardly on inside surface 68 of side walls 40 to floor 46. As shown in FIGS. 1, 2 and 3, posts 60 are located midway between adjacent corner blocks 44.

Top edges 70 of corner blocks 44 are located below the top edges 60 of side walls 40 and top edges 72 of end walls 42. Bottom surfaces 74 of blocks 44 extend below bottom surface 58 of housing 12. Holes 76 extend vertically through blocks 44, opening out onto top and bottom edges 70, 74 respectively.

As shown in FIG. 2, floor 46 of housing 12 includes a pair of spaced apart, parallel passages 78 extending therethrough and extending between side walls 40. Walls 80 defining passages 78 are stepped to provide upwardly facing shoulders 82 with lower wall sections 80-L below and upper wall sections 80-U above.

Contact units 14, 16, shown exploded from housing 12 in FIGS. 2 and 3, are identical and accordingly, are interchangeable. Each contact unit 14, 16 includes the aforementioned contact elements 20 fixed in an elongated member 84 of an insulating material such as a thermoplastic polyester resin with about 30 percent by weight of glass mixed thereinto. One supplier of such a material is the DuPont Corporation which sells it under the trademark RYNITE 530.

Figure 4:
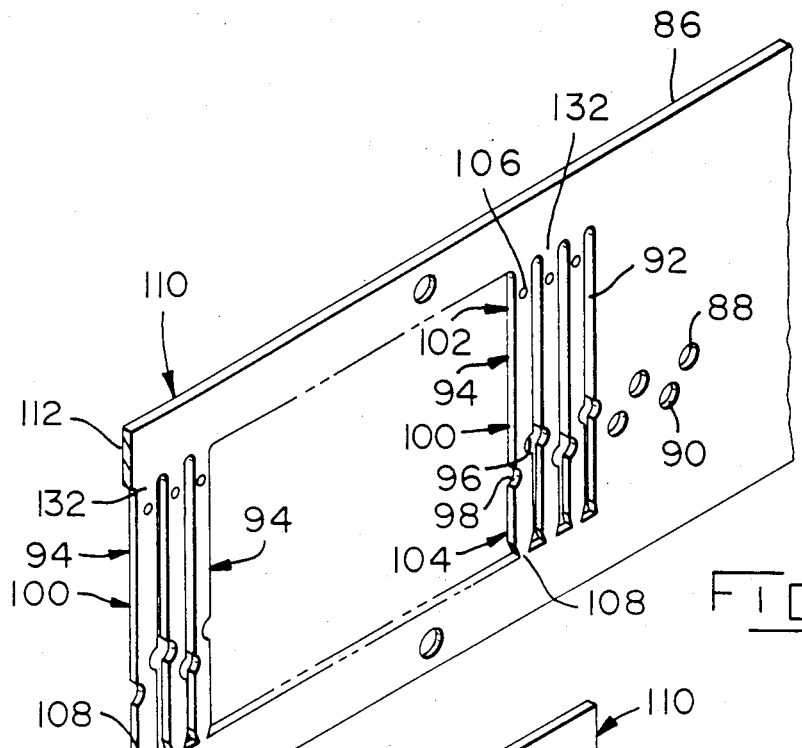
FIG. 4 is a perspective view of a strip of stamped contact elements.
Figure 5:
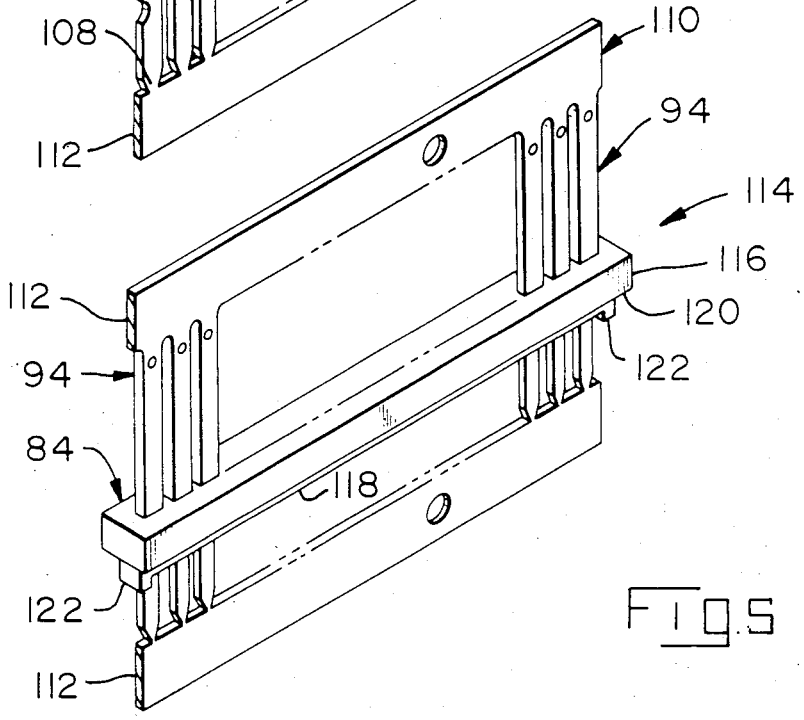
FIG. 5 is a perspective view of the strip of contact elements shown in FIG. 4 after being molded into the dielectric carrier.
Figure 6:
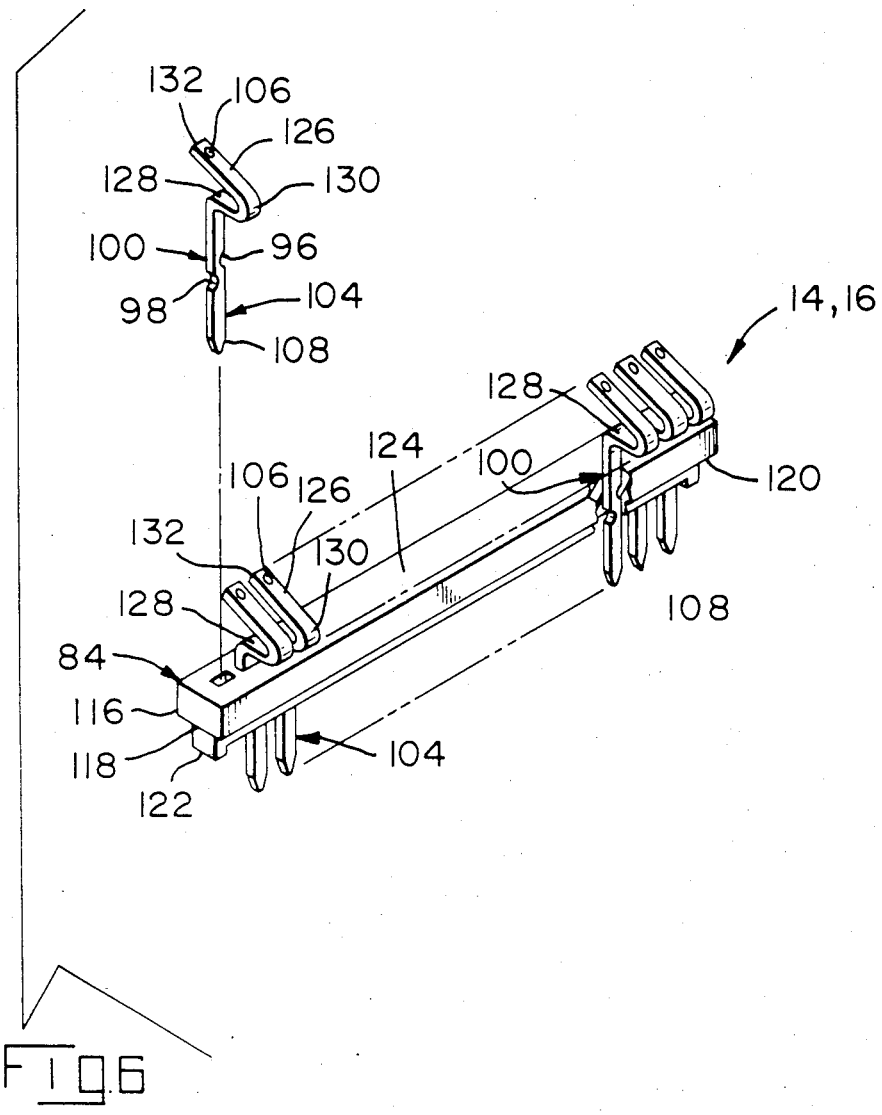
FIG. 6 is a partly sectioned perspective view of an insert molded contact element unit with one element being exploded out therefrom.

One method of making contact units 14, 16 is generally indicated in FIGS. 4, 5 and 6. The first phase is feeding coplanar strip 86 (right hand side of FIG. 4) of suitable conductive material; e.g., phos-bronze, through stamping stations (not shown). The results of the stamping and generally the sequence is shown in FIG. 4. Holes 88, 90 are punched into strip 86 with holes 88 being above and horizontally displaced relative to holes 90. Metal is then removed, as indicated by slots 92, to profile contact blanks 94. Note that in removing the metal, remnants of holes 88, 90 are left to provide arcuate grooves 96, 98, one on each side of blank 94 and vertically displaced relative to each other. Grooves 96, 98 are located within portion 100 of blank 94 which is intermediate upper portion 102 and lower portion or post 104. Upper portion 102 is embossed to provide a raised contact surface 106 adjacent end 132. Tip 108 of post 104 is preferably beveled as shown. An alternative to grooves 96, 98 would be holes (not shown) in intermediate portion 100 provided blank 94 is wide enough.

As shown on the left hand side of FIG. 4, the completed stamping phase provides a strip 110 of contact blanks 94 equally spaced along and attached to carrier strips 112 at ends 107 and tips 108.

The results of the next phase of the method is shown in FIG. 5. In this phase a section of strip 110, containing a pre-determined number of contact blanks 94, is placed in a molding station (not shown) with intermediate portion 100 positioned in a mold (not shown). Carrier strips 112 serve to keep contact blanks 94 in precise spacing relative to each other so that the only alignment fixture required in association with the mold is one which cooperates with carrier strips 112. After injecting a suitable resin into the mold; e.g., the aforementioned RYNITE 530 polyester resin, and curing, member 84 is formed and pre-formed unit 114 is obtained. Member 84, encapsulating intermediate portions 100 of contact blanks 94, includes upper section 116, lower section 118 of lesser width and downwardly facing shoulders 120. Depending standoffs 122 are provided on each end of lower section 118.

An alternative method of adding member 84 would be to feed continuous strip 110 through a continuous molding wheel (not shown) similar to the one disclosed in U.S. Pat. No. 4,080,148.

Following the insert molding phase, at least carrier strip 112 attached to upper portions 102 is broken away and upper portions 102 are formed to define contact elements 20 and complete contact units 14, 16 as shown in FIG. 6. With respect to top surface 124 of member 84, upper portions 102 are bent to provide an inclined cantilever spring arm 126, parallel portion 128 and concavo-convex or arcuate spring portion 130 which connects spring arm 126 and parallel portion 128. Raised contact surface 106 is located adjacent free end 132 of arm 126.

FIG. 6 shows one contact element 20 exploded from member 84 and also a portion thereof has been removed to show resin in grooves 96, 98 which helps in firmly securing elements 20 therein.

Figure 7:
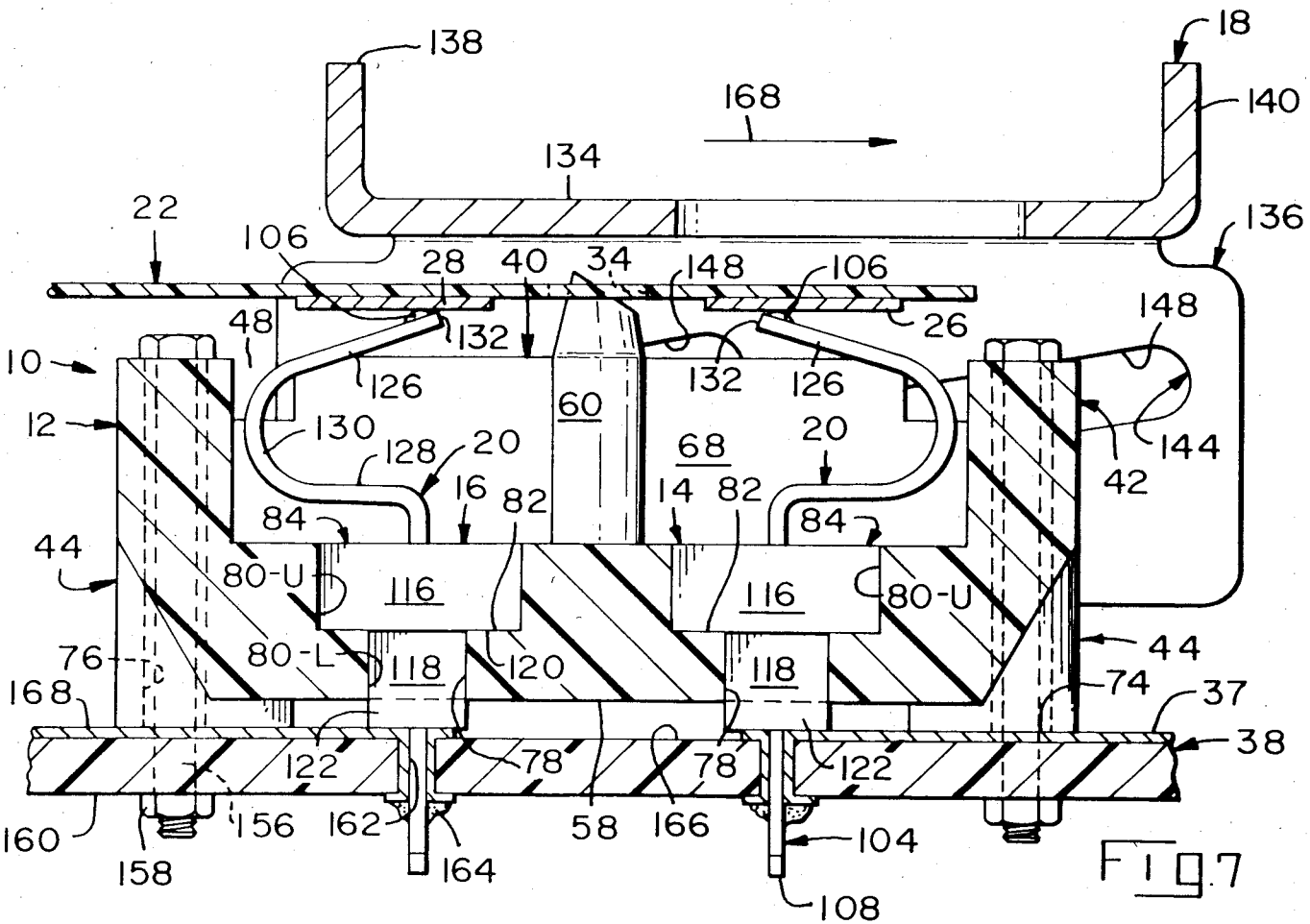
FIG. 7 is a partly sectioned, side view of an assembled electrical connector with a flexible film strip positioned therein for termination thereto.

As shown in FIG. 7, contact units 14, 16 are positioned in passages 78 in housing 12 with lower portions 104 of contact elements 20 extending downwardly below bottom surface 58 thereof. Contact units 14, 16 are supported therein by downwardly facing shoulders 120 of members 84 resting on upwardly facing shoulders 82 and are confined by upper wall sections 80-U engaging upper sections 116 of members 84 and lower wall sections 80-L engaging lower sections 118 of members 84. Contact units 14, 16 are orientated in housing 12 so that free ends 132 on contact unit 14 faces free ends 132 on contact unit 16. Contact units 14, 16 are bonded or otherwise secured in housing 12.

Cover 18, as shown in FIG. 1, is stamped and formed from sheet metal such as steel and plated with tin-lead over copper. Cover 18 includes an elongated base member 134 with turned down sides defining cam plates 136 and with turned up ends providing both structural strength for cover 18 and actuating members 138, 140. Oval shaped holes 142 are punched through base member 134 adjacent each cam plate 136 and member 140.

Cam slots 144 are provided in cam plates 136 and include an larger section 146 and a smaller section 148, the latter being substantially narrower than the former. Slots 144 are inclined with respect to the plane of base member 134 with the slope being upwardly from the front end; i.e., member 138, towards the back end containing member 140. EAch cam plate 136 further includes an inwardly projecting rib 150 embossed therein and located adjacent lower edge 152.

Figure 8:
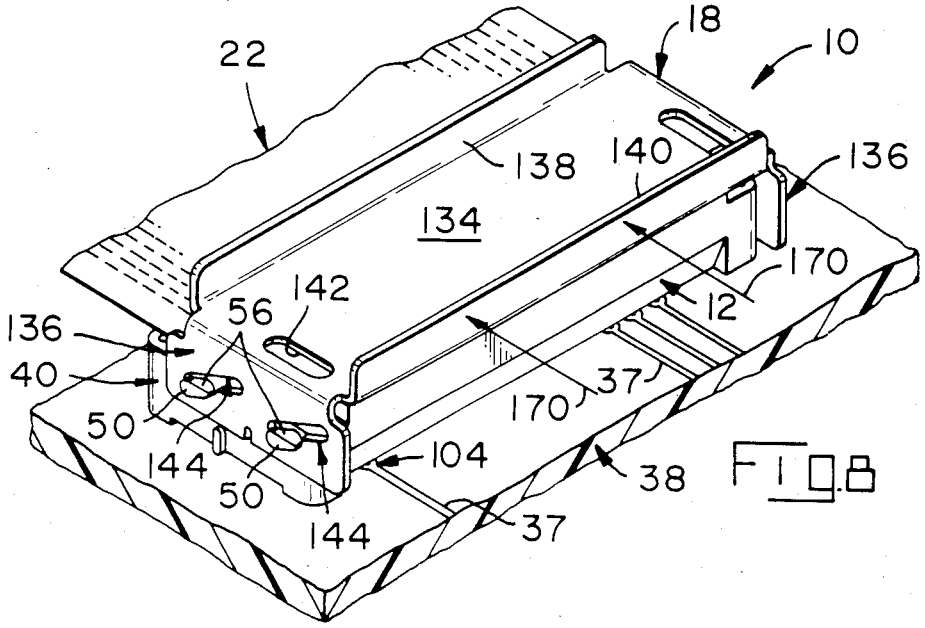
FIG. 8 is a perspective view of the electrical connector shown in FIG. 7.

As shown in FIG. 8, cover 18 is located on housing 12 with cam plates 136 extending down over side walls 40 and cam bosses 50 deposed in cam slots 144. Beveled upper surfaces 56 of cam bosses 50 facilitate plates 136 sliding down over bosses 50. Plates 136 are spaced outwardly from walls 40 by inwardly projecting ribs 150 slidingly engaging outer surfaces 54 thereof.

Functionally, as cover 18 is moved relative to housing 12, cam bosses 50, interacting with cam slots 144, force base member 134 to move perpendicularly towards and away from housing 12. FIGS. 7 through 12 illustrate the aforementioned functionality in more detail.

FIG. 7 is a cross-sectional side view of connector 10 mounted on circuit board 38. Connector 10 is secured to board 154 by bolts 156, shown in phantom, extending through holes 76 in corner blocks 44 and holes (not shown) in board 154 and threaded to nuts 158 on under surface 160. Posts 104 of contact elements 20 extend through holes 162, which may be plated, of board 38 and are soldered therein as indicated by solder fillets 164. Alternatively, posts 104 may be provided with compliant sections (not shown) which are frictionally received in holes 162 and do not require soldering but can be soldered if desired. As shown, bottom surface 58 of housing 12 is spaced above upper surface 166 of board 38 by bottom surfaces 74 of blocks 44 and standoffs 122 on contact units 14, 16. The space permits washing between lower section 118 of contact units 14, 16 and surface 166 of board 38.

FIGS. 7 through 12 illustrate terminating flexible film strip 22 in connector 10 to electrically connect circuits 24 thereon to circuit traces on board 154.

With reference to FIG. 7, cover 18 is held back in the direction of arrows 168 to space base member 134 above cantilever spring arms 126 which extend above housing 12. Film strip 22 is inserted into the space on top of cantilever spring arms 126 and positioned so that posts 60 on housing 12 are received in holes 34. This insures correct registration of conductive pads 26, 28 with contact surfaces 106 of spring arms 126 in contact units 14, 16 respectively.

As shown in FIGS. 8 and 9, connector 10 is in an open condition as indicated by cam bosses 50 being in sections 146 of cam slots 144. In closing connector 10, force is applied to cover 18; i.e., member 140, in the direction indicated by arrows 170. As cover 18 moves across the top of housing 12, cam bosses 50 in cam slots 144 force cover 18 to also move towards housing 12. This oblique closing motion moves base member 134 into engagement with flexible film strip 22 and presses it against cantilever spring arms 126 on contact elements 20. Further oblique closing motion resiliently bends spring arms 26 within cavity 48 of housing 12 and contact surfaces 106 wipingly move across conductive pads 26, 28, wiping debris therefrom to provide clean contact surfaces therebetween.

As cover 18 moves downwardly, posts 60 enter oval shaped holes 142 in base member 134. Inwardly projecting ribs 150 on plates 136 slide along outer surface 54 of side walls 40.

Figure 10:
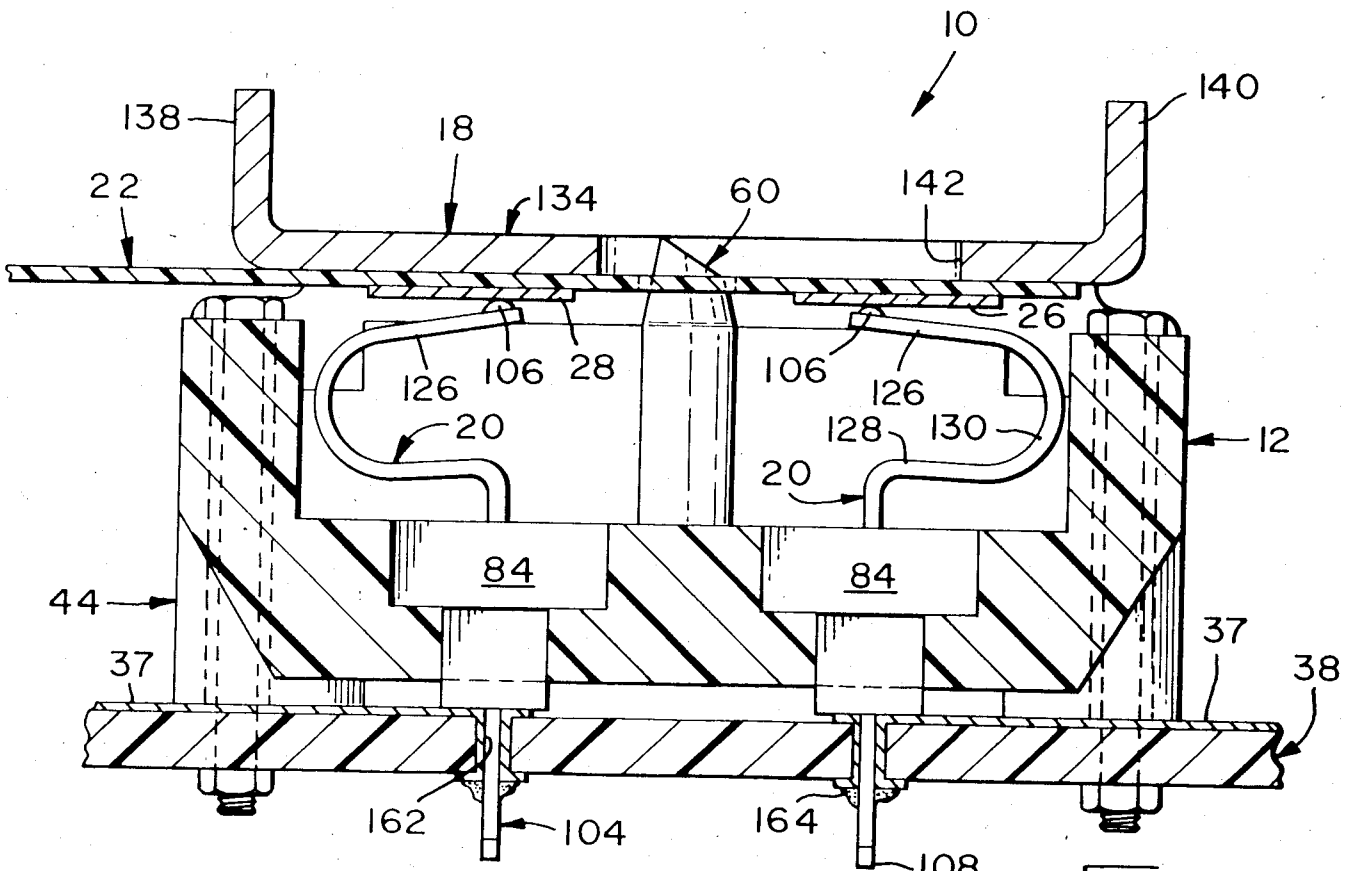
FIG. 10 is a partly sectioned side view of the electrical connector with the flexible film strip terminated therein.
Figure 11:
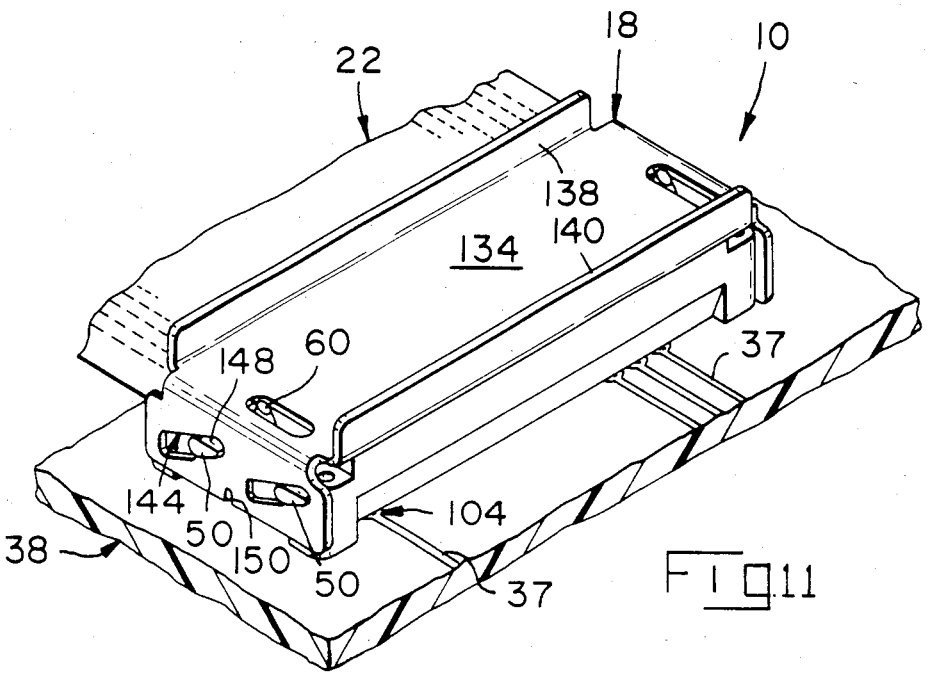
FIG. 11 is a perspective view of the electrical connector shown in FIG. 10.
Figure 12:
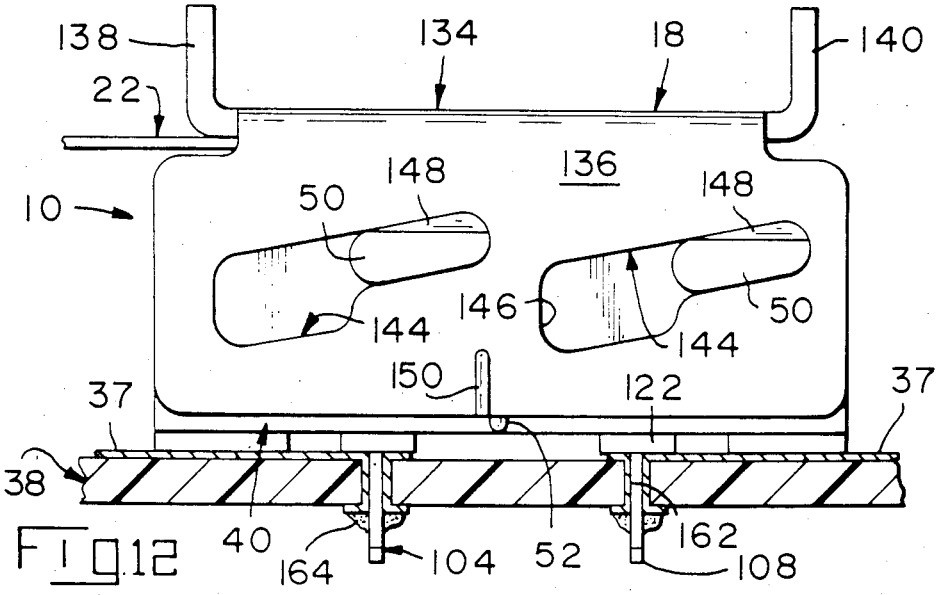
FIG. 12 is a side view of the electrical connector shown in FIG. 10.

FIGS. 10, 11, and 12 show connector 10 in a closed position. Cover 18 has been moved forwardly and downwardly to a position in which cantilever spring arms 126 are sufficiently compressed so that contact surfaces 106 exert a contact force against respective conductive pads 26, 28.

Cover 18 is locked in the closed position by inwardly projecting ribs 150 on plates 136 being lodged on the forward side of outwardly projecting ribs 52 on side walls 40 as shown in FIG. 12. Since a force is required to flex plates 136 outwardly to cam ribs 150 over ribs 52, cover 18 cannot inadvertently slide back and cause an electrical discontinuity between contact elements 20 and respective conductive pads 26, 28 of flexible film strip 22.

Connector 10 is opened by reversing the above described closing procedure; i.e., grasping member 140 and pulling in a direction opposite to that indicated by arrows 170 in FIGS. 8 and 9.

Modifications to which connector 10 is readily susceptible includes substituting surface mounted lower portions for posts 104. Also, rather than bonding contact units 14, 16 into housing 12, releasable locking means could be employed. This feature would be very desirable where posts 104 are fitted with compliant sections (not shown).

As can be discerned, an electrical connector has been disclosed which provides means for receiving a flexible film strip and electrically connecting the parallel, spaced apart conductors thereon with respective circuit traces on a circuit board on which the connector is mounted. The connector includes separate units having contact elements embedded therein. Further, a cover is mounted on the connector housing being moved from an open position to a closed position in which the conductors on the film strip are wipingly pressed against resilient cantilever spring arms on the contact elements.

I claim:

1. An electrical connector for electrically interconnecting conductors on a flexible film strip to circuit traces on a circuit board, comprising dielectric housing means having side walls and end walls and a floor defining an upwardly opened cavity and having elongated passage means extending through said floor;

first cam means provided on said side walls of said housing means;

elongated means disposed in said passage means including a plurality of conductive contact element means spaced along and supported in an insulative member means, said contact element means having contact means extending upwardly in said cavity and lower portion means depending from said housing means for electrical connection to said circuit traces on said circuit board; and cover means having base means and depending plate means at each side of said base means with second cam means thereon, said cover means being movably positioned on said housing means with said base means extending across the top of said housing means with a space therebetween to receive said flexible film strip, and said plate means extending along said side walls with said second cam means thereon cooperating with said first cam means on said side walls so that as said cover means is moved to a closed position, said first and second cam means cooperate to move said cover means towards said housing means so that said flexible film strip inserted between said cover means and said housing means is engaged by said base means and pressed against said contact means to establish electrical contact between the conductors on said film strip and said contact means.

2. The electrical connector of claim 1 wherein said contact element means include cantilever spring arms with embossed contact surfaces adjacent the free ends thereof.

3. The electrical connector of claim 2 wherein said contact element means further include an intermediate section embedded in said insulative member means.

4. The electrical connector of claim 3 wherein said insulative member means is formed around intermediate sections of said contact element means by injection molding.

5. The electrical connector of claim 4 wherein arcuate grooves are provided in said intermediate sections for receiving dielectric material during molding to more firmly secure said contact element means in said insulative member means.

6. The electrical connector of claim 5 wherein said dielectric material includes a thermoplastic polyester resin.

7. The electrical connector of claim 1 further including retaining means for retaining said flexible film strip on said housing means prior to said cover means being moved towards said housing means.

8. The electrical connector of claim 7 wherein said retaining means include posts on said side walls for being received in holes in said film strip.

9. The electrical connector of claim 1 further including locking means for locking said cover means in a closed position on said housing means.

10. The electrical connector of claim 9 wherein said locking means include cooperating means on said plate means and said side walls of said housing means.

11. The electrical connector of claim 10 wherein said cooperating means include outwardly projecting ribs on said side walls and inwardly projecting ribs on said plate means with said plate means being resiliently deflectable outwardly as said ribs thereon slide over said ribs on said side walls.

12. The electrical connector of claim 1 wherein said first and second cam means include cam bosses received in cam slots.

13. An electrical connector for interconnecting parallel, spaced apart circuit traces on a circuit board with parallel, spaced apart conductors on a film strip, comprising dielectric housing means having passage means extending therethrough and first cam means;

electrical contact element means disposed in said passage means including spring means with contact means located at free ends thereof such that the contact means are accessible from the top of said housing means and further having lower portions extending out from the bottom of said housing means to electrically engage respective circuit traces on said circuit board; and cover means having base means and second cam means, said cover means being positioned on said housing means with a closable space therebetween to receive said film strip and with said second cam means engaging said first cam means so that by moving said cover means from an open position to a closed position, said first and second cam means cooperate to move said base means against said film strip whereupon the conductors on the film strip electrically engage respective contact means on said spring means.

14. The electrical connector of claim 13 wherein said electrical contact element means are supported by insulative means disposed in said passage means.

15. The electrical connector of claim 13 wherein said spring means include a concavo-convex spring portion and a cantilever spring arm attached to and extending from said spring portion.

16. The electrical connector of claim 13 wherein said cover means include depending plate means located at opposing sides of said base means.

17. The electrical connector of claim 16 wherein said first cam means include cam bosses located on side walls of said housing means and said second cam means include cam slots in said plate means for receiving said cam bosses.

18. The electrical connector of claim 13 further including releasable locking means for locking said cover means in a closed position on said housing means.

19. The electrical connector of claim 13 further including post means on said housing means for retaining said film strip on said housing means prior to said cover means being moved towards said housing means.

* * * * *